United States Patent [19]

Makino et al.

[11] Patent Number: 4,636,323

[45] Date of Patent: Jan. 13, 1987

[54] LUBRICATING OIL COMPOSITION FOR METAL ROLLING

[75] Inventors: Yoshio Makino; Takeshi Nagai; Shingo Yamazaki, all of Hyogo, Japan

[73] Assignee: Nippon Oil and Fats Co., Ltd., Tokyo, Japan

[21] Appl. No.: 674,896

[22] Filed: Nov. 26, 1984

[30] Foreign Application Priority Data

Nov. 24, 1983 [JP] Japan ..... 58-219358

[51] Int. Cl.[4] ..... C10M 105/08

[52] U.S. Cl. ..... 252/51.5 R; 252/56 R; 252/56 S

[58] Field of Search ..... 252/51.5 R, 56 R, 56 B

[56] References Cited

U.S. PATENT DOCUMENTS

| | | | |
|---|---|---|---|
| 3,301,783 | 1/1967 | Dickson et al. | 252/51.5 R |
| 3,794,586 | 2/1974 | Kimura et al. | 252/51.5 R |
| 3,928,219 | 12/1975 | Papay et al. | 252/51.5 R |
| 4,064,059 | 12/1977 | Nebzydoski et al. | 252/51.5 R |
| 4,107,061 | 8/1978 | Sturnold et al. | 252/49.3 |
| 4,116,872 | 9/1978 | Jahnke | 252/32.5 |
| 4,138,370 | 2/1979 | Elliott et al. | 252/56 R |
| 4,256,591 | 3/1981 | Yamamoto et al. | 252/51.5 R |

FOREIGN PATENT DOCUMENTS

| | | |
|---|---|---|
| 2040934A | 12/1980 | United Kingdom . |
| 2115832A | 9/1983 | United Kingdom . |

*Primary Examiner*—William R. Dixon, Jr.
*Assistant Examiner*—Margaret B. Medley
*Attorney, Agent, or Firm*—Sughrue, Mion, Zinn Macpeak & Seas

[57] ABSTRACT

A lubricating oil composition for metal rolling is described, comprising (a) an oily component comprising one or more of fats and oils, mineral oils, and fatty acid esters, and (b) a dispersant comprising one or more of polyethyleneimine/epoxy compound adducts, polyethylene polyamine/epoxy compound adducts, fatty acid esters of the adducts, and salts of the adducts and the fatty acid esters. This composition is useful for rolling metals under high shear and high rolling speed conditions.

8 Claims, No Drawings

LUBRICATING OIL COMPOSITION FOR METAL ROLLING

FIELD OF THE INVENTION

The present invention relates to lubricating oil compositions for use in rolling metals.

BACKGROUND OF THE INVENTION

Lubricating oils for metal rolling which have been commonly used are oil-in-water (o/w) emulsions prepared by compounding a lubricating component (e.g., fats and oils, mineral oils, and fatty acid esters) and additives such as antioxidants, extreme pressure agents (EP agents), anti-corrosive agents, and oiliness agents, and then emulsifying by the use of emulsifiers. In recent years, with the advance of rolling techniques, rolling speed and also the size of equipment have been increased. The conventional o/w emulsions, however, are not satisfactory for use in these modern techniques, i.e., several problems are encountered in using the o/w emulsions. For example, when it is attempted to increase the amount of oil deposited on a metal to be rolled, the stability of the o/w emulsions is reduced, and, when recycled and reused, they become increasingly unstable and their rolling properties are deteriorated. On the contrary, if the o/w emulsion is excessively stable, sufficiently lubricity is not obtained due to decrease in the amount of oil deposited on the metal to be rolled. When such a stable o/w emulsion is sprayed on the metal to be rolled, a large part of the emulsion is not destroyed and remains in the stable o/w emulsion form and, thus the amount of oil spread on the metal is too low, which results in lubricity failure. That is, a preferred metal rolling dispersion for high speed rolling has stability sufficient to the extent that the dispersion is stable in a feeding line, but when the dispersion is sprayed onto a metal surface, the oil droplets can be easily destroyed, and after the rolling the dispersion condition can be easily revived.

In order to overcome the above problems, British Patent Application Laid-Open Nos. 2,048,934A and 2,115,832A have proposed an improved method. In this method, water-soluble anionic polymers such as polyacrylate salts, and polycarboxylic acid salts (e.g., salts of a methacrylic acid/maleic acid copolymer), water-soluble cationic polymers such as polymers of quaternary ammonium salts of nitrogen-containing monomers (e.g., vinyl pyridine and N,N-dimethylaminopropyl methacrylamide), or water-soluble amphoteric polymers such as copolymers of the above nitrogen-containing monomers and $\alpha,\beta$-unsaturated carboxylic acids or sulfonic acid group-containing vinyl compounds are added to the lubricating oil component (e.g., fats and oils, and wax) and, thereafter, the lubricating oil component is dispersed in the form of particles having a relatively large particle diameter by application of shearing force. The thus-prepared dispersions are then sprayed on the roll and metal to be rolled.

Lubricating oils for metal rolling as prepared by the above improved method, however, are not sufficiently satisfactory. With these lubricating oils, as long as the number of repeated uses is small, the amount of oil deposited is large and they retain their excellent rolling performance (lubricity). If, however, the number of repeated uses is increased, the dispersibility is reduced. This makes difficult uniform deposition of the lubricating oil component and leads to a decrease in the amount of oil deposited; that is, their rolling performance (lubricity) is reduced.

SUMMARY OF THE INVENTION

As a result of extensive investigations to overcome the above problems of the conventional lubricating oils for metal rolling, it has been found that if specific dispersants to disperse the oily component in water are chosen, lubricating oils can be obtained which are suitable for use in rolling of metals under high shear and high rolling speed conditions, i.e., exhibit good deposition of oily component on the metals, form a strong and thick lubricating film on the metals, and, even when used repeatedly, retain good dispersion stability, produce only slight unevenness in the amount of oil deposited, and thus are convenient to control.

Thus, the present invention relates to a lubricating oil composition for metal rolling comprising:

(a) an oily component comprising one or more of fats and oils, mineral oils, and fatty acid esters, and (b) a dispersant comprising one or more of polyethyleneimine/epoxy compound adducts, polyethylene polyamine/epoxy compound adducts, fatty acid esters of said adducts, and salts of said adducts and said fatty acid esters.

DETAILED DESCRIPTION OF THE INVENTION

Typical examples of mineral oils, animal and vegetable fats and oils, and fatty acid esters which can be used as the oily component of the present invention are shown below.

Mineral oils include spindle oil, machine oil, turbine oil, cylinder oil, etc.

Animal and vegetable fats and oils include tallow, lard, rapeseed oil, coconut oil, palm oil, rice bran oil, their hydrogenated products, etc.

Fatty acid esters include esters of fatty acids obtained from the above animal and vegetable fats and oils, or fatty acids constituting the fats and oils (i.e., a saturated or unsaturated fatty acid having from 12 to 24 carbon atoms) (such as lauric acid, myristic acid, palmitic acid, stearic acid, arachidonic acid, behenic acid, oleic acid, erucic acid, linoleic acid, and linolenic acid), and primary alcohols having from 1 to 22 carbon atoms (such as methanol, ethanol, propanol, butanol, octanol, dodecanol, hexadecanol, and octadecanol) or polyhydric alcohols having from 2 to 6 hydroxyl groups (such as ethylene glycol, propylene glycol, neopentyl glycol, glycerol, trimethylolpropane, pentaerythritol, and dipentaerythritol).

These compounds can be used singly or in combination with each other; that is, the oily component of the present invention can be composed of one or more of the compounds.

As the dispersant of the present invention, polyethyleneimine/epoxy compound adducts, polyethylene polyamine/epoxy compound adducts, their fatty acid esters, or salts of the adducts and the esters are used.

Polyethyleneimine used as a starting material for the polyethyleneimine/epoxy compound adducts has an average molecular weight of from 300 to 100,000.

Polyethylene polyamines which can be used include diethylenetriamine, triethylenetetramine, tetraethylenepentamine, pentaethylenehexamine, and N-aminoethylpiperazine.

Epoxy compounds which can be used in preparation of the adducts include ethylene oxide, propylene oxide, butylene oxide, tetrahydrofuran, and styrene oxide. The mole number of the epoxy compound added is from 1 to 100 moles per active hydrogen of the polyethyleneimine or polyethylene polyamine. If the mole number is less than 1 mole or in excess of 100 moles, the resulting lubricating oil is reduced in dispersibility when used repeatedly and its rolling performance drops.

The polyethyleneimine/epoxy compound adducts or polyethylene polyamine/epoxy compound adducts (hereinafter referred to merely as an "adduct") may be a homopolymer or a copolymer. In the case of the copolymer, it may be a block copolymer or a random copolymer.

The adduct can be prepared by known procedures. For example, it can be readily prepared by adding an alkali catalyst such as potassium hydroxide to polyethyleneimine or polyethylene polyamine and then reacting an epoxy compound with the polyethyleneimine or polyethylene polyamine under pressure in the presence of the alkali catalyst.

Fatty acids which can be used in the preparation of the fatty acid esters of the above adducts include tallow fatty acids, lard fatty acids, rapeseed oil fatty acids, coconut oil fatty acids, palm oil fatty acids, rice bran oil fatty acids, and their hydrogenated products. In addition, fatty acids constituting the above fatty acids (e.g., a saturated or unsaturated fatty acid having from 12 to 24 carbon atoms), such as lauric acid, myristic acid, palmitic acid, stearic acid, arachidonic acid, behenic acid, oleic acid, erucic acid, linoleic acid, and linolenic acid can be used. These compounds can be used singly or in combination with each other.

The fatty acid esters of the adducts can be prepared by known procedures. For example, it can be readily prepared by dehydrate condensing an adduct and a fatty acid by heating in an inert gas atmosphere (e.g., nitrogen gas) in the absence of a catalyst or in the presence of an acid catalyst such as paratoluenesulfonic acid.

Salts of the adducts and salts of the fatty acid esters of the adducts are prepared by neutralizing the adducts or the fatty acid esters of the adducts with inorganic or organic acids such as phosphoric acid, sulfuric acid, hydrochloric acid, nitric acid, boric acid, formic acid, acetic acid and acid phosphoric ester (e.g., monoalkyl phosphate and dialkyl phosphate). If desired, the neutralization reaction can be carried out in the form of an aqueous solution.

The adducts and their fatty acid esters, and the salts of the adducts and fatty acid esters are good o/w dispersants for the oily component, fats and oils, mineral oils, and fatty acid esters. They can be used singly or in combination with each other; that is, the dispersant of the present invention is composed of one or more of the adducts, fatty acid esters of the adducts, and salts of the adducts and fatty acid esters.

In the lubricating oil composition of the present invention, the preferred weight ratio of the oily component to the dispersant is from 85/15 to 99.95/0.05. If the dispersant is added so that the weight ratio is more than the above-defined upper limit, i.e., the amount of the dispersant used is very small, the resulting lubricating oil composition has some tendency to decrease in dispersion stability during the use thereof. On the other hand, even if the dispersant is added in such greater amounts that the weight ratio is below the lower limit, no additional beneficial effect can be expected.

The lubricating oil composition of the present invention may contain known additives such as anti-corrosive agents, antioxidants, extreme pressure agents, and oiliness agents.

The lubricating oil composition of the present invention is used in the form of oil-in-water dispersions. The effective content of the composition in the dispersions is from 0.5 to 10% by weight. If it is less than 0.5% by weight, sufficient rolling performance (lubricity) is not obtained. If it is in excess of 10% by weight, the amount of oil deposited on the metal to be rolled is too large, which is uneconomical and which results in undesirable slipping of rolls, degreasing failure after the metal rolling, and acceleration of deterioration of the dispersion.

The lubricating oil composition of the present invention is particularly useful for metal rolling under high shear and high rolling speed conditions. That is, even under such conditions, the amount of oil deposited is large, even if used repeatedly, it retains good dispersion stability and produces only slight unevenness in the amount of oil deposited, and thus it is convenient to control. Because of such excellent lubricating performance, the lubricating oil composition of the present invention can be conveniently used, for example, in rolling of steel plates.

The present invention is described in greater detail with reference to the following examples.

EXAMPLES 1 TO 22 AND COMPARATIVE EXAMPLES 1 TO 6

Tallow (38.8 g) and an aqueous solution of a given amount of a dispersant of the present invention or a comparative dispersant in 960 g of water were placed in a homogenizer (T.K. Autohomomixer M type, manufactured by Tokushukika Kogyo Kabushiki Kaisha) and stirred at 60° C. for 5 minutes at 7,000 rpm to prepare a dispersion.

The thus-prepared dispersion was sprayed for 3 seconds under conditions of pressure 2.5 kg/cm$^2$ and spraying amount 1.3 l/min onto a test piece (50×100×1 mm SPCE-SD steel plate (JIS G 3141) which had been degreased with a solvent) maintained at 160° C. The thus-sprayed dispersion was recovered, stirred in the homomixer under the same conditions as above, and then sprayed under the same conditions as above onto the test piece which had been freshly heated. This procedure was repeated and the dispersion was used repeatedly. Then, the amount of oil deposited on the test piece and the dispersion stability of the dispersion were determined.

The amount of oil deposited on the test piece was indicated as a difference in weight of the test piece between prior to spraying of the dispersion and after spraying and drying at 105° C. for 1 hour. In determining the dispersion stability, the recovered dispersion was heated to 60° C., stirred in the homomixer at 7,000 rpm for 2 minutes and further at 300 rpm for 1 hour, and then the condition of the dispersion was examined. The rating for each dispersion regarding the dispersion stability was graded as follows:

A: Almost no separated oil was present in the upper layer.

B: A small amount of separated oil was present in the upper layer.

C: A fairly large amount of separated oil was present in the upper layer.

D: Most of the oily component separated from the dispersion.

The results are shown in Table 1.

DETA: diethylenetriamine
TETA: triethylenetetramine
PEHA: pentaethylenehexamine

TABLE 1

| | Dispersant* | | Amount of Oil Deposited ($\times 10^{-2}$ g) Number of Repeated Uses | | | | Dispersion Stability Number of Repeated Uses | | | |
|---|---|---|---|---|---|---|---|---|---|---|
| | Type | Amount (g) | 1 | 7 | 15 | 20 | 1 | 7 | 15 | 20 |
| Example No. | | | | | | | | | | |
| 1 | Phosphoric acid salt of PEI (MW = 300)-$(PO)_1$-$(EO)_5$ | 1.2 | 1.75 | 1.65 | 1.72 | 1.68 | A | A | A | A |
| 2 | Phosphoric acid salt of PEHA-$(SO)_2$-$(PO)_5$-$(EO)_{20}$ | 1.5 | 1.64 | 1.72 | 1.86 | 1.73 | A | A | A | B |
| 3 | Acetic acid salt of PEI (MW = 300)-$(EO)_5$ | 1.4 | 1.68 | 1.53 | 1.68 | 1.63 | A | A | A | B |
| 4 | Phosphoric acid salt of PEI (MW = 1,800)-$(PO)_{10}$-$(EO)_{30}$ | 2.0 | 1.72 | 1.64 | 1.61 | 1.63 | A | A | A | A |
| 5 | PEHA/PEI (MW = 1,800) (30% by weight/70% by weight) mixture-$(PO)_{20}$-$(EO)_{50}$ | 0.9 | 1.62 | 1.51 | 1.51 | 1.59 | A | A | A | B |
| 6 | Phosphoric acid salt of PEI (MW = 30,000)-$(BO)_2$-$(PO)_5$-$(EO)_{15}$ | 1.4 | 1.78 | 1.79 | 1.65 | 1.61 | A | A | A | A |
| 7 | Phosphoric acid salt of DETA-$(PO)_3$-$(EO)_7$ | 1.5 | 1.52 | 1.68 | 1.54 | 1.51 | A | A | A | A |
| 8 | PEHA-$(PO)_3$-$(EO)_7$ | 1.5 | 1.65 | 1.59 | 1.73 | 1.55 | A | A | A | A |
| 9 | Phosphoric acid salt of PEHA-$(PO)_3$-$(EO)_7$ | 0.7 | 1.64 | 1.72 | 1.72 | 1.63 | A | A | A | B |
| 10 | Phosphoric acid salt of tallow fatty acid ester (degree of esterification = 10%) of PEI (MW = 600)-$(EO)_4$ | 1.2 | 1.61 | 1.70 | 1.72 | 1.68 | A | A | A | B |
| 11 | Tallow fatty acid ester (degree of esterification = 50%) of TETA/PEI (MW = 600)(50% by weight/50% by weight) mixture-$(BO)_1$-$(EO)_4$ | 1.2 | 1.59 | 1.71 | 1.74 | 1.66 | A | A | A | B |
| 12 | Stearic acid ester (degree of esterification = 30%) of TETA-$(EO)_{20}$ | 1.5 | 1.62 | 1.73 | 1.78 | 1.63 | A | A | A | A |
| 13 | Oleic acid ester (degree of esterification = 40%) of PEI (MW = 1,800)-$(EO)_{80}$ | 1.5 | 1.58 | 1.75 | 1.80 | 1.70 | A | A | A | B |
| 14 | Tallow fatty acid ester (degree of esterification = 30%) of PEHA/PEI (MW = 600)(50% by weight/50% by weight) mixture-$(SO)_1$-$(PO)_{24}$-$(EO)_6$ | 1.5 | 1.60 | 1.76 | 1.78 | 1.68 | A | A | A | A |
| 15 | Phosphoric acid salt of tallow fatty acid ester (degree of esterification = 70%) of PEI (MW = 600)-$(EO)_5$ | 1.5 | 1.80 | 1.75 | 1.68 | 1.72 | A | A | A | B |
| 16 | Phosphoric acid salt of tallow fatty acid ester (degree of esterification = 70%) of PEI (MW = 1,800)-$(EO)_5$ | 1.5 | 1.68 | 1.59 | 1.62 | 1.66 | A | A | B | B |
| 17 | Boric acid salt of tallow fatty acid ester (degree of esterification = 70%) of PEI (MW = 600)-$(EO)_5$ | 1.12 | | | | | | | | |
| | Boric acid salt of tallow fatty acid ester (degree of esterification = 70%) of PEI (MW = 1,800)-$(EO)_5$ | 0.38 | 1.85 | 1.80 | 1.78 | 1.82 | A | A | A | A |
| 18 | Diethyl phosphate salt of tallow fatty acid ester (degree of esterification = 70%) of PEI (MW = 600)-$(EO)_5$ | 0.55 | | | | | | | | |
| | Diethyl phosphate salt of tallow fatty acid ester (degree of esterification = 70%) of PEI (MW = 1,800)-$(EO)_5$ | 0.20 | 2.18 | 2.09 | 1.95 | 1.98 | A | A | A | A |
| 19 | Phosphoric acid salt of tallow fatty acid ester (degree of esterification = 95%) of PEI (MW = 600)-$(EO)_5$ | 1.0 | 2.30 | 2.35 | 2.26 | 2.19 | A | B | B | B |
| 20 | Phosphoric acid salt of tallow fatty acid ester (degree of esterification = 70%) of PEI (MW = 1,800)-$(EO)_5$ | 0.1 | | | | | | | | |
| | Phosphoric acid salt of tallow fatty acid ester (degree of esterification = 95%) of PEI (MW = 600)-$(EO)_5$ | 0.9 | 1.88 | 1.81 | 1.78 | 1.83 | A | A | A | A |
| 21 | Monobutyl phosphate salt of oleic acid ester (degree of esterification = 60%) of PEI (MW = 1,800)-$(PO)_5$-$(EO)_4$ | 1.5 | 1.68 | 1.70 | 1.73 | 1.66 | A | A | B | B |
| 22 | Phosphoric acid salt of stearic acid ester (degree of esterification = 80%) of PEI (MW = 30,000)-$(PO)_2$-$(EO)_{20}$ | 1.2 | 1.66 | 1.68 | 1.70 | 1.73 | A | A | A | A |
| Comparative Example No. | | | | | | | | | | |
| 1 | Na salt of acrylic acid/maleic acid (1/1) copolymer (MW = 6,000) | 1.5 | 1.64 | 1.85 | 0.74 | 0.63 | A | B | B | D |
| 2 | Polymer of quaternary ammonium salt of dimethylaminopropylmethacrylamide with methyl chloride (MW = 600,000) | 1.5 | 1.72 | 1.54 | 1.01 | 0.85 | A | A | B | D |
| 3 | Copolymer of diethylaminoethyl methacrylate/acetic acid salt of vinylpyridine/sodium methacrylate (2/2/1) copolymer (MW = 130,000) | 1.5 | 1.82 | 1.59 | 0.95 | 0.72 | A | A | C | C |
| 4 | Oleylamine/EO (90 mol) adduct | 1.5 | 1.75 | 1.50 | 1.00 | 0.77 | A | A | B | D |
| 5 | Stearic acid/EO (35 mol) adduct | 1.5 | 1.70 | 1.51 | 0.98 | 0.81 | A | A | B | D |
| 6 | Phosphoric acid salt of PEI (MW = 30,000) | 1.5 | 1.65 | 1.60 | 0.92 | 0.74 | A | A | C | D |

The symbols used in the column of the dispersants are as follows:

PEI: polyethyleneimine
EO: ethylene oxide
PO: propylene oxide
BO: butylene oxide SO: styrene oxide The epoxy compounds were prepared by block polymerization, and the order of addition and the added mole number per active hydrogen are shown.

The dispersants used in Examples 10 to 22 were fatty acid esters of polyethyleneimine/epoxy compounds adducts or polyethylene polyamine/epoxy compound adducts. The degree of esterification indicated in the parentheses indicates the proportion of esterified hydroxyl groups in relation to the total hydroxyl groups in the adduct.

It can be seen from the results shown in Table 1 that even if the lubricating oil compositions of the present invention are used repeatedly, their dispersion stability is good and the amount of oil deposited is constant. Furthermore, it can be seen that the lubricating oil compositions of the present invention are good in dispersion stability even if the amount of the dispersant added is changed.

EXAMPLES 23 TO 35 AND COMPARATIVE EXAMPLES 7 TO 10

40 g of a mixture of an oily component and an additive (the types of the oily component and the additive and the formulation of the oily component and additive are shown in Table 2), and 1.5 g of a dispersant of the present invention or a comparative dispersant as shown in Table 2 in 1,000 g of water were placed in a homogenizer and stirred at 50° C. for 5 minutes at 10,000 rpm to prepare a dispersion.

The thus-prepared dispersions were tested for the amount of oil deposited and dispersion stability in the same manner as in Example 1.

In Table 2 below, the dispersants being indicated as "(random)" are the adducts prepared by random copolymerization of the epoxy compounds, and the other dispersants are adducts prepared by block copolymerization of the epoxy compounds.

The antioxidant used in Table 2 is 2,4-di-tert-butyl-p-cresol.

TABLE 2

| Example No. | Oily Component and Additive | wt % | Dispersant | Amount of Oil Deposited ($\times 10^{-2}$ g) Number of Repeated Uses 1 | 15 | 20 | Dispersion Stability Number of Repeated Uses 1 | 15 | 20 |
|---|---|---|---|---|---|---|---|---|---|
| 23 | Tallow | 97 | Phosphoric acid salt of TETA-$(BO)_2$-$(PO)_7$-$(EO)_{10}$ | 1.72 | 1.53 | 1.61 | A | A | A |
| | Tallow fatty acid | 2 | | | | | | | |
| | Antioxidant | 1 | | | | | | | |
| 24 | Paraffin-based mineral oil | 50 | Phosphoric acid salt of PEI (MW = 1,800)-$(PO)_3$-$(EO)_{12}$ | 1.82 | 1.75 | 1.70 | A | A | A |
| | Tallow | 20 | | | | | | | |
| | Tallow fatty acid butyl ester | 27 | | | | | | | |
| | Antioxidant | 1 | | | | | | | |
| | Phosphate-based extreme pressure agent | 2 | | | | | | | |
| 25 | Tallow | 60 | Acetic acid salt of PEI (MW = 30,000)-$(SO)_1$-$(PO)_{10}$-$(EO)_{20}$ | 1.65 | 1.68 | 1.53 | A | A | B |
| | Methyl stearate | 37 | | | | | | | |
| | Antioxidant | 1 | | | | | | | |
| | Phosphate-based extreme pressure agent | 2 | | | | | | | |
| 26 | Paraffin-based mineral oil | 67 | Phosphoric acid salt of PEHA-$(PO)_{15}$-$(EO)_{10}$ | 1.68 | 1.59 | 1.57 | A | A | B |
| | Tallow fatty acid 2-ethylhexyl ester | 27 | | | | | | | |
| | Tallow fatty acid | 5 | | | | | | | |
| | Antioxidant | 1 | | | | | | | |
| 27 | Tallow | 97 | Tallow fatty acid ester (degree of esterification = 30%) of PEI (MW = 600)-$(EO)_{20}$ | 1.70 | 1.66 | 1.61 | A | A | A |
| | Tallow fatty acid | 2 | | | | | | | |
| | Antioxidant | 1 | | | | | | | |
| 28 | Paraffin-based mineral oil | 50 | Phosphoric acid salt of stearic acid ester (degree of esterification = 30%) of PEHA-$(PO)_6$-$(EO)_{20}$ | 1.72 | 1.68 | 1.63 | A | A | A |
| | Tallow | 20 | | | | | | | |
| | Tallow fatty acid butyl ester | 27 | | | | | | | |
| | Antioxidant | 1 | | | | | | | |
| | Phosphate-based extreme pressure agent | 2 | | | | | | | |
| 29 | Tallow | 97 | Phosphoric acid salt of tallow fatty acid ester (degree of esterification = 70%) of PEI (MW = 600)-$(EO)_5$ 1.12 g; Phosphoric acid salt of tallow fatty acid ester (degree of esterification = 70%) of PEI (MW = 1,800)-$(EO)_5$ 0.38 g | 1.95 | 1.83 | 1.88 | A | A | A |
| | Tallow fatty acid | 2 | | | | | | | |
| | Antioxidant | 1 | | | | | | | |
| 30 | Paraffin-based mineral oil | 50 | Monobutyl phosphate salt of oleic acid ester of PEI (MW = 1,800)-$(PO)_5$-$(EO)_4$ (random) | 1.59 | 1.60 | 1.55 | A | A | A |
| | Tallow | 20 | | | | | | | |
| | Tallow fatty acid butyl ester | 27 | | | | | | | |

TABLE 2-continued

| | Oily Component and Additive | wt % | Dispersant | Amount of Oil Deposited ($\times 10^{-2}$ g) Number of Repeated Uses 1 | 15 | 20 | Dispersion Stability Number of Repeated Uses 1 | 15 | 20 |
|---|---|---|---|---|---|---|---|---|---|
| | Antioxidant | 1 | | | | | | | |
| | Phosphate-based extreme pressure agent | 2 | | | | | | | |
| 31 | Tallow | 60 | Phosphoric acid salt of tallow fatty acid ester (degree of esterification = 95%) of PEI (MW = 600)-$(EO)_5$ 1.35 g | | | | | | |
| | Methyl stearate | 37 | | | | | | | |
| | Antioxidant | 1 | | | | | | | |
| | Phosphate-based extreme pressure agent | 2 | Phosphoric acid salt of tallow fatty acid ester (degree of esterification = 70%) of PEI (MW = 1,800)-$(EO)_5$ 0.15 g | 1.68 | 1.59 | 1.65 | A | A | A |
| 32 | Paraffin-based mineral oil | 67 | Oleic acid ester (degree of esterification = 70%) of PEHA-$(EO)_{90}$ | 1.83 | 1.76 | 1.80 | A | A | B |
| | Tallow fatty acid 2-ethylhexyl ester | 27 | | | | | | | |
| | Tallow fatty acid | 5 | | | | | | | |
| | Antioxidant | 1 | | | | | | | |
| 33 | Tallow | 97 | Oleic acid ester (degree of esterification = 80%) of PEI (MW = 1,800)-$(BO)_2$-$(PO)_5$-$(EO)_{15}$ (random) | 2.14 | 1.95 | 2.04 | A | A | A |
| | Tallow fatty acid | 2 | | | | | | | |
| | Antioxidant | 1 | | | | | | | |
| 34 | Tallow | 60 | Phosphoric acid salt of tallow fatty acid ester (degree of esterification = 70%) of PEI (MW = 1,800)-$(PO)_3$-$(EO)_{12}$ | 1.65 | 1.62 | 1.63 | A | A | B |
| | Olive oil fatty acid butyl ester | 37 | | | | | | | |
| | Antioxidant | 1 | | | | | | | |
| | Phosphate-based extreme pressure agent | 2 | | | | | | | |
| 35 | Paraffin-based mineral oil | 67 | Monobutyl phosphate salt of stearic acid ester (degree of esterification = 50%) of PEHA-$(PO)_6$-$(EO)_{20}$ | 1.73 | 1.67 | 1.65 | A | A | B |
| | Erucic acid 2-ethylhexyl ester | 27 | | | | | | | |
| | Tallow fatty acid | 5 | | | | | | | |
| | Antioxidant | 1 | | | | | | | |
| Comparative Example No. | | | | | | | | | |
| 7 | Tallow | 97 | Polymer of quaternary ammonium salt of dimethylaminopropylmethacrylamide with methyl chloride (MW = 600,000) | 1.75 | 1.21 | 0.79 | A | B | D |
| | Tallow fatty acid | 2 | | | | | | | |
| | Antioxidant | 1 | | | | | | | |
| 8 | Tallow | 97 | Polyoxyethylene (10 mol) nonylphenyl ether | 1.60 | 1.17 | 0.70 | A | B | D |
| | Tallow fatty acid | 2 | | | | | | | |
| | Antioxidant | 1 | | | | | | | |
| 9 | Paraffin-based mineral oil | 50 | Phosphoric acid salt of PEI (MW = 30,000) | 1.55 | 1.10 | 0.69 | A | B | D |
| | Tallow | 20 | | | | | | | |
| | Tallow fatty acid butyl ester | 27 | | | | | | | |
| | Antioxidant | 1 | | | | | | | |
| | Phosphate-based extreme pressure agent | 2 | | | | | | | |
| 10 | Paraffin-based mineral oil | 50 | Phosphoric acid salt of dimer acid/diethylenetriamine | 1.60 | 1.22 | 1.00 | A | B | C |
| | Tallow | 20 | (1/1.1 by mol) condensate | | | | | | |
| | Tallow fatty acid butyl ester | 27 | | | | | | | |
| | Antioxidant | 1 | | | | | | | |
| | Phosphate-based extreme pressure agent | 2 | | | | | | | |

It can be seen from the results shown in Table 2 that even if the kind of the oily component is changed or the additive is added, the lubricating oil compositions of the present invention show good dispersion stability and deposit the proper amount of oil.

EXAMPLES 36 TO 42 AND COMPARATIVE EXAMPLES 11 AND 12

Lubricating oil compositions according to the present invention or comparative lubricating oil compositions were diluted with water to concentrations of 2% or 4%, and then stirred in a homogenizer to prepare a dispersion. A steel rolling test was carried out using this dispersion under the following conditions:

Test Condition:

Work roll: Polished roll having a diameter of 60 mm and a length of 200 mm

Steel used: Low carbon steel coil (SPCC, JIS G 3141) having a thickness of 0.8 mm and a width of 80 mm Temperature of the dispersion: 45° C.

Rate of dispersion feeding: 3.9 l/min

Work roll surface velocity: 30 m/min

Rolling pass schedule: See Table 3, and total time of the rolling passes is 1 hour.

TABLE 3

| | Pass Times | | | | |
|---|---|---|---|---|---|
| | 1 | 2 | 3 | 4 | 5 |
| Thickness of steel after pass (mm) | 0.68 | 0.51 | 0.33 | 0.20 | 0.12 |
| Total reduction ratio (%) | 15 | 36 | 59 | 75 | 85 |

Test Method:

(1) Lubricity

In accordance with the rolling pass schedule as shown in Table 3 above, steel was passed through working rolls. The rolling load required for each pass was measured by a load cell. Lubricity of the dispersion of the lubricating oil composition was evaluated based on the ratio of the rolling load required on the 5th pass (i.e., for a total reduction ratio of 85%) to the rolling load required on the 5th pass (i.e., for a total reduction ratio of 85%) of Comparative Example 11.

Ratio of Rolling Load $= Y/X$

X: Rolling load (tons) required for total reduction ratio of 85% at the final pass (i.e., 5th pass) of Comparative Example 11.

Y: Rolling load (tons) required for total reduction ratio of 85% at the final pass (i.e., 5th pass) of Examples 36 to 42 or Comparative Example 12.

The lower the ratio of rolling load is, the better the lubricity is. When the ratio of rolling load is less than 1, the lubricity is superior to that of the lubricating oil composition of Comparative Example 11.

(2) Dispersion Stability

Dispersion stability before the steel rolling test was measured as follows. The dispersion was fed to a pump attached to the rolling machine and the dispersion was circulated through the pump for 10 minutes to thoroughly stir the dispersion. The resulting dispersion was stirred in the homogenizer at 300 rpm for 1 hour, and then the condition of the dispersion was examined by the same evaluation grades of A, B, C and D as in Example 1.

Dispersion stability after the steel rolling test was measured as follows. The dispersion was recovered, stirred in the homogenizer at 300 rpm for 1 hour and evaluated by the same evaluation grades of A, B, C and D as in Example 1.

The results of the determinations of the ratio of rolling load and the dispersion stability are shown in Tables 4-1 and 4-2 below, together with the composition of the lubricating oil compositions.

TABLE 4-1

| | Lubricating Oil Composition | wt % | Concentration (%) | Ratio of Rolling Load | Dispersion Stability: Before Rolling Test | Dispersion Stability: After Rolling Test |
|---|---|---|---|---|---|---|
| Example No. | | | | | | |
| 36 | Tallow | 93 | 2 | 0.82 | A | A |
| | Tallow fatty acid | 2 | | | | |
| | Antioxidant | 1 | | | | |
| | Phosphoric acid salt of tallow fatty acid ester (degree of esterification = 70%) of PEI (MW = 600)-$(EO)_5$ | 4 | | | | |
| 37 | Tallow | 95 | 2 | 0.75 | A | B |
| | Tallow fatty acid | 2 | | | | |
| | Antioxidant | 1 | | | | |
| | Boric acid salt of tallow fatty acid ester (degree of esterification = 70%) of PEI (MW = 600)-$(EO)_5$ | 1.5 | | | | |
| | Boric acid salt of tallow fatty acid ester (degree of esterification = 70%) of PEI (MW = 800)-$(EO)_5$ | 0.5 | | | | |
| 38 | Tallow | 89 | 2 | 0.87 | A | A |
| | Tallow fatty acid | 2 | | | | |
| | Antioxidant | 1 | | | | |
| | Monobutyl phosphate salt of oleic acid ester (degree of esterification = 60%) of PEI (MW = 1,800)-$(PO)_5$-$(EO)_4$ (random) | 8 | | | | |
| Comparative Example No. | | | | | | |
| 11 | Tallow | 95 | 2 | 1.00 (control) | B | D |
| | Tallow fatty acid | 2 | | | | |
| | Antioxidant | 1 | | | | |
| | Polyethylene glycol (MW = 400) mono-tallow fatty acid ester | 0.5 | | | | |
| | Pentaerythritol mono-oleate | 1.2 | | | | |
| | Tallow alcohol/EO (12 mol) adduct | 0.3 | | | | |

TABLE 4-2

| | Lubricating Oil Composition | wt % | Concentration (%) | Ratio of Rolling Load | Dispersion Stability: Before Rolling Test | Dispersion Stability: After Rolling Test |
|---|---|---|---|---|---|---|
| Example No. | | | | | | |
| 39 | Paraffin-based mineral oil | 50 | 4 | 1.45 | A | A |
| | Tallow | 20 | | | | |

TABLE 4-2-continued

| | Lubricating Oil Composition | wt % | Concentration (%) | Ratio of Rolling Load | Dispersion Stability Before Rolling Test | Dispersion Stability After Rolling Test |
|---|---|---|---|---|---|---|
| | Tallow fatty acid butyl ester | 22 | | | | |
| | Antioxidant | 1 | | | | |
| | Phosphate-based extreme pressure agent | 2 | | | | |
| | Phosphoric acid salt of tallow fatty acid ester (degree of esterification = 95%) of PEI (MW = 600)-$(EO)_5$ | 4.5 | | | | |
| | Phosphoric acid salt of tallow fatty acid ester (degree of esterification = 70%) of PEI (MW = 1,800)-$(EO)_5$ | 0.5 | | | | |
| 40 | Paraffin-based mineral oil | 50 | 4 | 1.41 | A | A |
| | Tallow | 20 | | | | |
| | Tallow fatty acid butyl ester | 25 | | | | |
| | Antioxidant | 1 | | | | |
| | Phosphate-based extreme pressure agent | 2 | | | | |
| | Phosphoric acid salt of stearic acid ester (degree of esterification = 80%) of PEI (MW = 30,000)-$(PO)_2$-$(EO)_{20}$ | 2 | | | | |
| 41 | Paraffin-based mineral oil | 50 | 4 | 1.46 | A | B |
| | Tallow | 20 | | | | |
| | Tallow fatty acid butyl ester | 15 | | | | |
| | Antioxidant | 1 | | | | |
| | Phosphate-based extreme pressure agent | 2 | | | | |
| | Phosphoric acid salt of PEI (MW = 1,800)-$(PO)_{10}$-$(EO)_{30}$ (random) | 12 | | | | |
| 42 | Paraffin-based mineral oil | 50 | 4 | 1.37 | A | B |
| | Tallow | 20 | | | | |
| | Tallow fatty acid butyl ester | 26 | | | | |
| | Antioxidant | 1 | | | | |
| | Phosphate-based extreme pressure agent | 2 | | | | |
| | Phosphoric acid salt of tallow fatty acid ester (degree of esterification = 70%) of PEI (MW = 1,800)-$(EO)_5$ | 1 | | | | |
| Comparative Example | | | | | | |
| 12 | Paraffin-based mineral oil | 50 | 4 | 1.52 | B | C |
| | Tallow | 20 | | | | |
| | Tallow fatty acid butyl ester | 25 | | | | |
| | Antioxidant | 1 | | | | |
| | Phosphate-based extreme pressure agent | 2 | | | | |
| | Polyethylene glycol (MW = 400) mono-tallow fatty acid ester | 0.50 | | | | |
| | Pentaerythritol mono-oleate | 1.20 | | | | |
| | Tallow alcohol/EO (12 mol) adduct | 0.30 | | | | |

It is apparent from the results of Table 4-1 that when the concentration of the dispersion is 2%, the lubricating oil compositions of the present invention (Examples 36 to 38) show superior lubricity (i.e., lower ratio of rolling load) and dispersion stability compared to those of Comparative Example 11. Further, it is also apparent from the results in Table 4-2 that when the concentration of the dispersion is 4%, the lubricating oil compositions of the present invention (Examples 39 to 42) show superior lubricity and dispersion stability compared to those of Comparative Example 12.

While the invention has been described in detail and with reference to specific embodiments thereof, it will be apparent to one skilled in the art that various changes and modifications can be made therein without departing from the spirit and scope thereof.

What is claimed is:

1. A lubricating oil composition for metal rolling comprising (a) an oily component comprising one or more of fats and oils, mineral oils, and fatty acid esters, and (b) a dispersant comprising one or more of salts of fatty acid esters of polyethyleneimine/epoxy compound adducts wherein said salts are salts resulting from neutralization with phosphoric acid, boric acid, or acid phosphoric ester, and wherein the weight ratio of the oily component (a) to the dispersant (b) is from 85/15 to 99.95/0.05.

2. A composition as in claim 1, wherein the average molecular weight of the polyethyleneimine is from 300 to 100,000.

3. A composition as in claim 1, wherein the epoxy compound is ethylene oxide, propylene oxide, butylene oxide, tetrahydrofuran, or styrene oxide, and the added mole number is from 1 to 100 moles per active hydrogen of the polyethyleneimine or polyethylene polyamine.

4. A composition as in claim 1, wherein the fatty acid ester as the oily component is an ester derived from (1) a saturated or unsaturated fatty acid having from 12 to 24 carbon atoms and (2) a primary alcohol having from 1 to 22 carbon atoms, or a polyhydric alcohol having from 2 to 6 hydroxyl groups.

5. A composition as in claim 4, wherein the fatty acid is lauric acid, myristic acid, palmitic acid, stearic acid, arachidonic acid, behenic acid, oleic acid, erucic acid, linoleic acid, linolenic acid, or a mixture thereof.

6. A composition as in claim 4, wherein the primary alcohol is methanol, ethanol, propanol, butanol, octanol, dodecanol, hexadecanol, or octadecanol.

7. A composition as in claim 4, wherein the polyhydric alcohol is ethylene glycol, propylene glycol, neopentyl glycol, glycerol, trimethylolpropane, pentaerythritol, or dipentaerythritol.

8. A composition as in claim 1, wherein the lubricating oil composition is used in the form of oil-in-water dispersion in an amount of from 0.5 to 10% by weight of the composition based on the total weight of the dispersion.

* * * * *